US008622245B2

(12) United States Patent
Zakrzewski et al.

(10) Patent No.: US 8,622,245 B2
(45) Date of Patent: Jan. 7, 2014

(54) SEALING CONDITION OF MULTIPLE-CONTAINER, IN PARTICULAR DOUBLE-TUBE, PACKAGES DESIGNED FOR INSTANT PREPARATION

(75) Inventors: Herve Zakrzewski, Verdun (FR); Eric Kerman, Chalons en Champagne (FR)

(73) Assignee: Cebal S.A.S., Sainte Menehould (FR)

( * ) Notice: Subject to any disclaimer, the term of this patent is extended or adjusted under 35 U.S.C. 154(b) by 1115 days.

(21) Appl. No.: 11/915,791

(22) PCT Filed: May 22, 2006

(86) PCT No.: PCT/FR2006/001163

§ 371 (c)(1),
(2), (4) Date: Nov. 28, 2007

(87) PCT Pub. No.: WO2006/128993

PCT Pub. Date: Dec. 7, 2006

(65) Prior Publication Data

US 2008/0121653 A1 May 29, 2008

(30) Foreign Application Priority Data

May 30, 2005 (FR) ..... 05 05449

(51) Int. Cl.
*B65D 35/22* (2006.01)

(52) U.S. Cl.
USPC ..... 222/94; 222/153.06; 222/541.8

(58) Field of Classification Search
USPC ..... 222/94, 541.7, 541.8, 153.06, 153.09, 222/541.6, 541.9, 562; 220/258.5; 215/48
See application file for complete search history.

(56) References Cited

U.S. PATENT DOCUMENTS

| | | | | |
|---|---|---|---|---|
| 2,218,092 | A * | 10/1940 | Nitardy | 222/94 |
| 2,249,832 | A * | 7/1941 | Hubschman | 222/420 |
| 3,135,428 | A * | 6/1964 | Gallo | 222/94 |
| 4,666,063 | A * | 5/1987 | Holoubek et al. | 222/107 |
| 5,211,341 | A * | 5/1993 | Wieczorek | 239/585.3 |
| 5,219,373 | A * | 6/1993 | Hatakeyama et al. | 29/458 |
| 5,328,056 | A * | 7/1994 | Schneider et al. | 222/94 |
| 6,116,441 | A * | 9/2000 | Decelles et al. | 215/237 |
| 6,176,395 | B1 * | 1/2001 | Abbott et al. | 222/94 |
| 6,347,726 | B1 * | 2/2002 | Jackson et al. | 222/94 |
| 6,634,524 | B1 * | 10/2003 | Helmenstein | 222/94 |
| 7,207,607 | B2 * | 4/2007 | Brugner et al. | 285/401 |
| 7,306,130 | B2 * | 12/2007 | Brugner | 222/541.6 |

FOREIGN PATENT DOCUMENTS

| | | |
|---|---|---|
| EP | 0093185 | 11/1983 |
| FR | 1209359 | 3/1960 |
| WO | 9308117 | 4/1993 |

* cited by examiner

*Primary Examiner* — Kevin P Shaver
*Assistant Examiner* — Daniel R Shearer
(74) *Attorney, Agent, or Firm* — Ladas & Parry LLP

(57) ABSTRACT

A double dispensing container including an outer container and an inner container, each container including a body and a head provided with a neck and a shoulder linking the neck to the body, the neck having a side wall and one or more dispensing orifices, the neck of the inner container being housed inside the neck of the outer container and having a section such that it provides one of more outflow passages for a pasty product A and, in combination with the inner surface of the outer container neck, one or more outflow passages for a pasty product B emerging onto a single or multiple orifice dispensing the product B. The inner neck is extended by a summit portion which is linked to the inner neck via a thin annular zone and which closes the single or multiple orifice dispensing product A.

12 Claims, 8 Drawing Sheets

SEALING CONDITION OF MULTIPLE-CONTAINER, IN PARTICULAR DOUBLE-TUBE, PACKAGES DESIGNED FOR INSTANT PREPARATION

FIELD OF THE INVENTION

The invention concerns packaging with several recipients provided with dispensing necks adjacent or placed side by side and used for storing and distributing different liquid, viscous, creamy or pasty products simultaneously (these products will henceforward be referred to as "pasty"). In particular, it concerns flexible tubes known as "multiple" tubes. Such packaging is used to store products separately from each other and to dispense them simultaneously via openings that are close together and, if possible, side by side, for example with a view to preparing a magisterial (or extemporaneous) prescription of a pharmaceutical product in a particular dosage form that is not commercially available, or with a view to preparing an adhesive from polymerizing agents, typically a cyanoacrylate, or with a view to preparing a chemically unstable cosmetic product, such as hair dye (a mixture of an oxidizing agent and a precursor), or, finally, simply with a view to providing a pleasant, amusing visual aspect when simultaneously dispensing pasty products of different colors (hair gels, toothpaste, etc.).

DESCRIPTION OF RELATED ART

While single, separate recipients enable products to be kept intact before mixing, the point of having a multiple recipient is to facilitate package management by being certain, at any time, of having available all the constituent parts of the mixture to be made, and to make it easier to make said mixture. Another advantage, which has appeared over the last few years, is related to the pleasant and amusing visual effect of pasty products of different colors simultaneously coming out of neighboring openings.

Whether for an extemporaneous preparation or for a simple visual effect, the aim is to keep the different products contained in the multiple recipient isolated from each other until they are first used and, if possible, to continue to ensure perfect leak-tightness between these products after said first use. To illustrate the multiple recipients concerned by the invention, we shall describe multiple flexible tubes and, more specifically, double tubes.

A multiple flexible tube comprises a head with a multiple-opening neck, connected to an external flexible skirt via a shoulder. The tube may comprise several concentric skirts, the products being contained either in the inner volume of the tube itself, or between the walls of the tube skirt and that of the tube which immediately surrounds the previous tube. In general, these are double tubes, comprising an inside and an outside tube. Such multiple tubes are described in patent applications EP 0 561 719, WO 00/63112 and WO 00/6311, in which the inside tube is fitted into the outside tube.

Recently, other double tubes have been described, in which a single, flexible skirt forms the outer envelope of the multiple tube. At least one transverse wall separates the compartments in the inside volume bounded by the skirt, said compartments being designed to contain different products. Multiple tubes are described, for example, in application WO 00/55602.

The present invention more specifically concerns the first type of multiple tube in which the tubes are produced separately and then assembled like a nest of dolls, each tube, with the exception of the smallest, encasing a tube of smaller dimensions (the dimensions involved being at least the skirt diameter and the neck diameter). It can also apply to the second type of tube, even though the leak-tightness problem described below is less important, as this second type of double tube is of necessity obtained by molding a dispensing head with a complex shape and with multiple openings, the bulk of the difficulty here having to do with obtaining a leak-tight connection for the head, not only with the outside cylindrical skirt, but also with the internal separating wall.

In patent application FR 1 209 359, the "self-mixing" tube comprises three tubes with a neck closed by a top wall, each fitted into the others and held concentrically in relation to each other by their respective necks. As long as the tube is not open, the products conditioned in the three separate envelopes formed in this way are correctly isolated. The self-mixing tube is opened in a single operation by simultaneously perforating or cutting the walls of the three tubes at an appropriate point.

The tubes described in application WO 00/12309 are obtained in the following way:

a) an outside tube and an inside tube are made separately, the neck of the latter, having a complex shape, being designed so that it provides one or more flow paths for pasty product A that is to be contained in the inner tube and, in conjunction with the inside of the cylindrical wall of the neck of the outer tube, one or more flow paths for pasty product B that is to be contained between the inner tube and the outer tube, once these have been assembled;
b) the inner tube is assembled by insertion into the outer tube, the inner tube being held in place inside the outer tube at the level of the base of the neck using complementary means of axial fixing, typically a rib/groove clipping system.
c) the internal volume of the inner tube is filled with pasty product A;
d) the volume between the wall of the inner tube and that of the outer tube is filled with pasty product B;
e) the multiple tube is sealed by means of a final weld, by compressing and raising to a high temperature the open end of the skirt of the inner tube and the open end of the skirt of the outer tube, preferably simultaneously.

Prior to this, the tubes are made using conventional techniques: the head of the outer (or inner) tube is molded, the sprue removed and fixed to the end of a skirt that will become the outer skirt (or inner skirt). When the head is molded and fixed to the end of the skirt simultaneously (the head is overmolded to the end of the skirt), the molding tool is preferably designed so that the excess plastic resulting from the injection molding process (the sprue) or from the compression molding process, is localized above the top part of the neck. This surplus material must be removed. As the neck is cylindrical, said surplus material is removed, advantageously for large production runs, by turning, generally on devices known as plugging machines, where tubes, placed on rotary chucks, undergo various operations such as sprue removal, lid fitting, closure screwing, etc. But this process has the drawback of not being very accurate in terms of the both the axial positioning and the perpendicularity of the sprue removal cut. Because of this it is not possible to have perfect control over the neck height of each of these tubes, specifically the distance between the mouth—the top part of the neck—and the means of axial fixing designed to work in conjunction with the complementary means of axial fixing of the other tube. The dispersion of these heights and the imperfect perpendicularity of the cut do not make it possible to obtain leak-tightness between the products during storage, even before they are used for the first time. Consideration was given to the idea of using leak-tight seals with a staggered profile to match the differences between the mouths of the inner and outer necks, but this solution proved to be of little worth, either technically or economically.

The applicant therefore attempted to obtain a double tube by assembling an inner and an outer tube made separately, said double tube making it possible to store two products separately and in a leak-tight manner, before and even after they are used for the first time.

SUMMARY OF THE INVENTION

A first subject according to the invention is a double dispensing recipient comprising an outer and an inner recipient, said inner recipient being designed to contain a pasty product A and being housed inside the outer recipient in such a way that the volume bounded by its outer surface and the inner surface of the outer recipient is to contain a pasty product B, each recipient comprising a body and a head provided with a neck and a shoulder connecting said neck to said body, said neck having a side wall and an open end provided with one or more dispensing openings, the neck of the inner recipient being housed inside the neck of the outer recipient and having a cross-section shaped so as to offer one or more flow paths for dispensing pasty product A and, in combination with the inner surface of the neck of the outer recipient, one or more flow paths for pasty product B leading to a single or multiple opening for dispensing product B, wherein the inner neck is extended by means of a top portion which is connected to said neck by a slender ring-shaped zone and which blocks the single or multiple dispensing opening of product A.

The double dispensing recipient, according to the invention, may be a double tube, comprising an outer tube and an inner tube housed inside the outer tube so that the volume bounded by the outer surface of the inner tube and the inner surface of the outer tube can contain a pasty product B different from the pasty product A contained within the inner tube. Each tube comprises a flexible skirt and a head provided with a neck and a shoulder connecting said neck to said flexible skirt. Each of the parts of the recipient or of the tube will be referred to as inner if it belongs to the inner tube, and outer if it belongs to the outer tube.

The inner neck is housed inside the outer neck. It has a cross-section shaped so that it offers one or more flow paths for pasty product A, leading to one or more dispensing openings. In combination with the inner surface of the neck of the outer recipient, the outer surface of the inner neck offers one or more flow paths for pasty product B leading to a single or multiple opening. The inner neck is covered by a top portion which is connected to said inner neck by a slender ring-shaped zone, i.e. less thick than that of the barrel of the inner neck and that of the top portion. This top portion closes the single or multiple dispensing opening of product A contained within the inner tube.

In a first embodiment of the invention, the top portion may, for example, be a single top wall which includes said slender ring-shaped zone, the outline of the latter bounding the desired shape of the opening or openings. The slender ring-shaped zone is a breakable area that comprises a notch, whose cross-section in a plane comprising the axis of the neck is turned in a direction that is substantially parallel with said axis. In such a geometrical layout, the top portion acting as a lid may be removed by exerting an axial force perpendicular to said top wall.

But in order to improve hermetic separation between product A and product B after they have been used for the first time, it is preferable to provide the inner neck with said top wall by locating the slender ring-shaped zone on the side wall of said inner neck, so that once burst, the open end of the inner neck systematically protrudes beyond the mouth of the outer neck, whatever the dispersions due to manufacturing tolerance. In such a case, the end of the inner neck is extended by means of a top portion connected to said inner neck by a slender ring-shaped zone located on the barrel of the neck and preferably notched so as to localize deformation until bursting occurs during first-time use. The inner head assembly, including the top portion can to advantage be molded in a single piece and the mold is designed so that the slender ring-shaped zone is accessible after the two tubes have been assembled: once the slender ring-shaped zone has been burst and the top portion detached, the open end of the inner neck protrudes slightly from the mouth of the outer neck, which makes it possible to provide, by means of a leak-tight seal placed on the cap, at the bottom of the screw thread, for example, hermetic separation between product A and B.

According to this method of the invention, slender ring-shaped zone is a breakable area which extends on the side wall from the inner neck with a notch whose cross-section in a plane comprising the axis of the inner neck is turned in a direction that is substantially perpendicular with said axis. In this case, the breakable zone is placed at a distance from the means of axial fixing (typically a rib clipping system) such that the breakable area is on the outside after assembly of the inner tube and the outer tube, i.e. it is "above" the mouth of the outer neck (the tube being conventionally presented vertically, with the head at the top). In this way, if a double tube is produced according to the process describes in WO 00/63112, the axial position of the breakable zone is defined by a certain distance from the rib clipping system located at the base of the inner neck; said distance has to be higher than the distance between the mouth of the outer neck and the clip-on groove of the outer neck The top portion, acting as a lid, can be cleanly cut out using a cutting tool which is moved along the slender ring-shaped zone. The top portion can be made to move greatly in relation to the remainder of the inner neck, this large relative movement resulting in a large deformation located in the slender ring-shaped zone, which then bursts. If the top portion is provided with a grooved side wall or one that is polygonal in cross-section, preferably concave (star-shaped, for example), this can easily be made to rotate around the axis of the neck. One can thus impose on the top portion of the inner neck can thus be made to undergo a large rotation, while the remainder of the double tube is motionless.

Whatever the form of the inner neck, therefore, the top portion closing the inner (single or multiple) opening and separated from said inner neck by said breakable zone can have an arbitrary form appropriate to the application of a large movement (typically a rotation) which said top portion is made to undergo.

It may, for example, have a polygonal edge cross-section, that can easily be made to rotate. To tear this breakable zone the first time the recipient is used, the closure cap may be used, to avoid having to use of a special tool. This latter has, for example on the outer wall, following the example of the closure cap described in application EP 0 192 136, a housing of a shape that is complementary to that of the side wall of the top portion. This housing, once the cap has been turned through 180° in relation to its usual closing position, acts as a lock inside which the top portion of the inner neck is inserted, this acting as a key. The cap is turned around the axis of the neck, causing a tear located at the level of the slender ring-shaped zone and the top portion is detached from the neck.

Obviously, the key-lock functions can be reversed. The top wall has in this case a cavity bordered by a ribbed inner side wall or one with a polygonal cross-section, preferably concave, and the closure cap has a protuberance complementary in shape on its outer wall.

The outer neck can to advantage also be surmounted by a top portion which closes the multiple opening. This top portion is also connected to the outer neck via a slender or notched ring-shaped zone. Preferably, this top portion is hollow so that the top portion of the inner tube can be housed in its cavity. Preferably also, in the version in which the top portion is torn by rotation, the inner and outer surfaces of its side wall typically have a polygonal contour, typically star-shaped; for the first, this is complementary to the contour of the side wall of the top portion of the inner neck and, for the second, it is complementary to the contour of the inner surface of the cap. In this way, rotating the cap leads to bursting of the two breakable areas which connect the inner and outer top portions to their respective neck.

The invention has been described relative to double tubes and double containers. It can of course be applied to containers or multiple tubes designed to contain more than two different products. Another subject of the invention is therefore a multiple dispenser including an outer container, an inner container and n intermediate containers ($n \geq 1$), said inner container being designed to contain a pasty product A and being placed inside an intermediate container, itself placed, like a nest of dolls, inside an intermediate container of greater dimensions, the largest of these being placed inside the outer container, each container being placed inside the container that is immediately larger so that the volume bounded by its outer surface and the inner surface of said immediately larger container can contain a pasty product Bi (l=1 to n+1) separated from the other pasty products, each container including a body and a head provided with a neck and a shoulder connecting said neck to said body, said neck having a side wall and an open end provided with one or more dispensing openings, the neck of the inner container being housed inside the neck of the outer container and having a cross-section with a shape such as offers at least one flow path for pasty product A and, in combination with the inner surface of the neck of the immediately larger container, at least one flow path for pasty product Bi, wherein the inner neck is prolonged by a top portion which is connected to said inner neck by a slender ring-shaped zone which closes the single or multiple dispensing opening of product A.

As indicated above, for each inner container, the neck of the immediately larger container is, to advantage, also surmounted by a top portion, connected to the neck of said container via a slender and/or notched ring-shaped zone. Preferably, this latter top portion is hollow so that the top portion of the immediately smaller container can be housed in its cavity.

Said slender and/or notched ring-shaped zone is placed on the wall of the neck of said inner container so that, after assembly of said neck with that of the immediately larger container, followed by bursting of the slender and/or notched ring-shaped zone and detachment of said top portion, the open end of said neck is above the mouth of the neck of the immediately larger container, the tube being presented vertically, with the head at the top.

BRIEF DESCRIPTION OF THE DRAWINGS

FIG. 1*a* shows a cross-section through a diametrical plan of the double tube with its closure cap before being used for the first time. FIG. 1*b* represents the double tube as, using the cap turned upside down, the top portion, which acts as a lid on the opening of the inner neck, is removed. FIG. 1*c* shows the double tube with its cap after having been used for the first time. FIG. 1*d* shows an axonometric projection of the double tube without its cap, before removal of the top portion acting as a lid on the inner neck. FIG. 1*e* shows the double tube without its cap in perspective, after removal of the top portion acting as a lid on the inner neck.

FIG. 2*a* shows a cross-section through a diametrical plan of the double tube with its closure cap before being used for the first time. FIG. 2*b* shows the double tube as, using the cap turned upside down, the top portion, which acts as a lid on the opening of the inner neck, is removed. FIG. 2*c* shows the double tube with its cap after having been used for the first time. FIG. 2*d* shows an axonometric projection of the double tube without its cap, before removal of the top portion acting as a lid on the inner neck. FIG. 2*e* shows the double tube without its cap in perspective, after removal of the top portion acting as a lid on the inner neck.

FIG. 3*a* shows a cross-section through a diametrical plan of the double tube with its closure cap before being used for the first time. FIG. 3*b* shows the double tube as, using the cap turned upside down, the top portion, which acts as a lid on the opening of the inner neck, is removed. FIG. 3*c* shows the double tube with its cap after having been used for the first time. FIG. 3*d* illustrates the head of the inner tube in perspective, before removal of the top portion acting as a lid.

FIG. 4*a* shows a cross-section through a diametrical plan of the double tube with its closure cap before being used for the first time. FIG. 4*b* shows the double tube as, using the cap turned upside down, the top portion, which acts as a lid on the opening of the inner neck, is removed. FIG. 4*c* shows the double tube with its cap after having been used for the first time.

DESCRIPTION OF THE PREFERRED EMBODIMENTS

Example 1

Figure 1A:
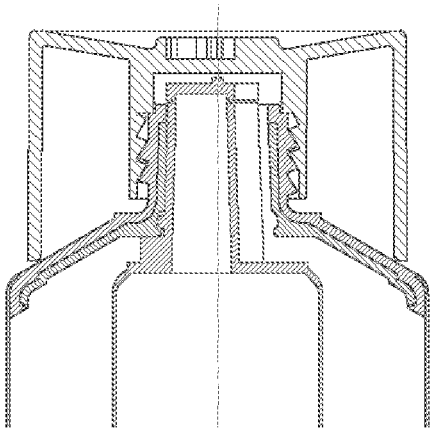
FIGS. 1*a*, 1*b*, 1*c*, 1*d* and 1*e* illustrate a first embodiment of the invention.
Figure 1B:
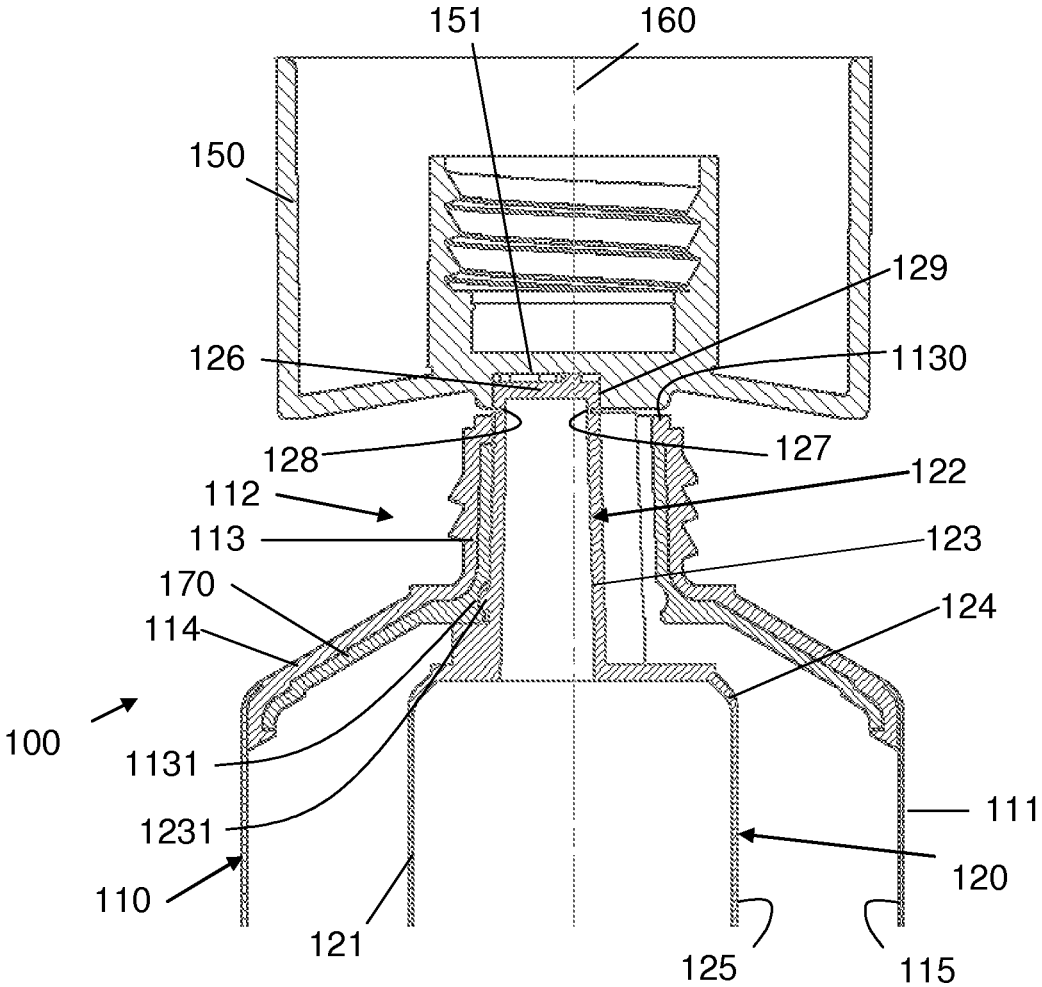
Figure 1C:
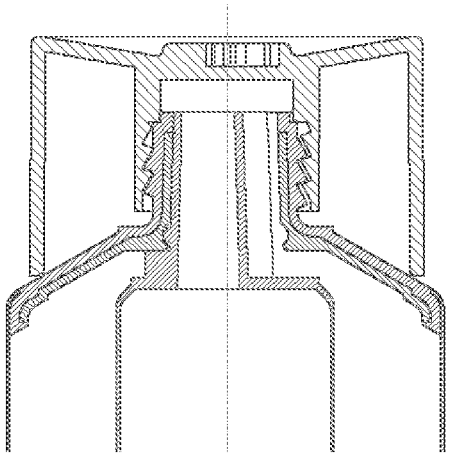
Figure 1D:
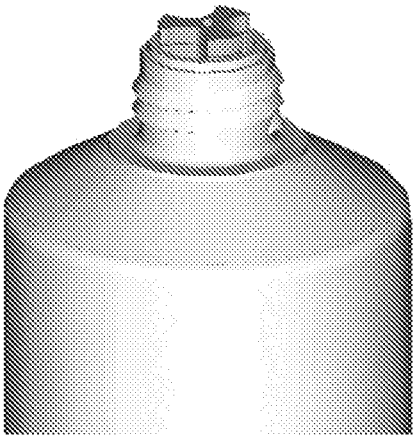
Figure 1E:
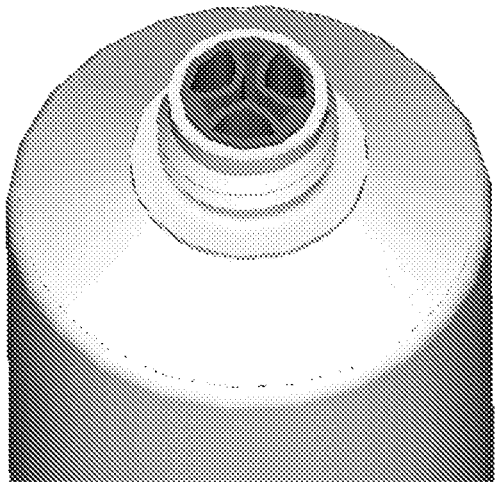
Figure 2A:
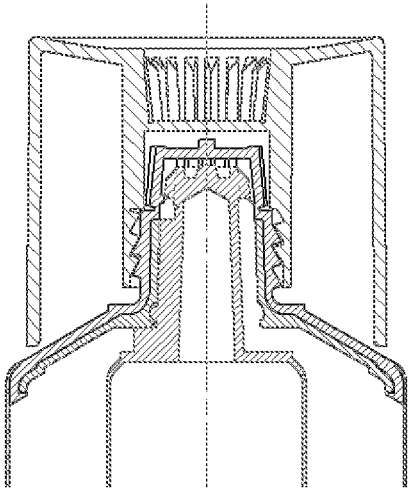
FIGS. 2*a*, 2*b*, 2*c*, 2*d* and 2*e* illustrate a second embodiment of the invention.
Figure 2B:
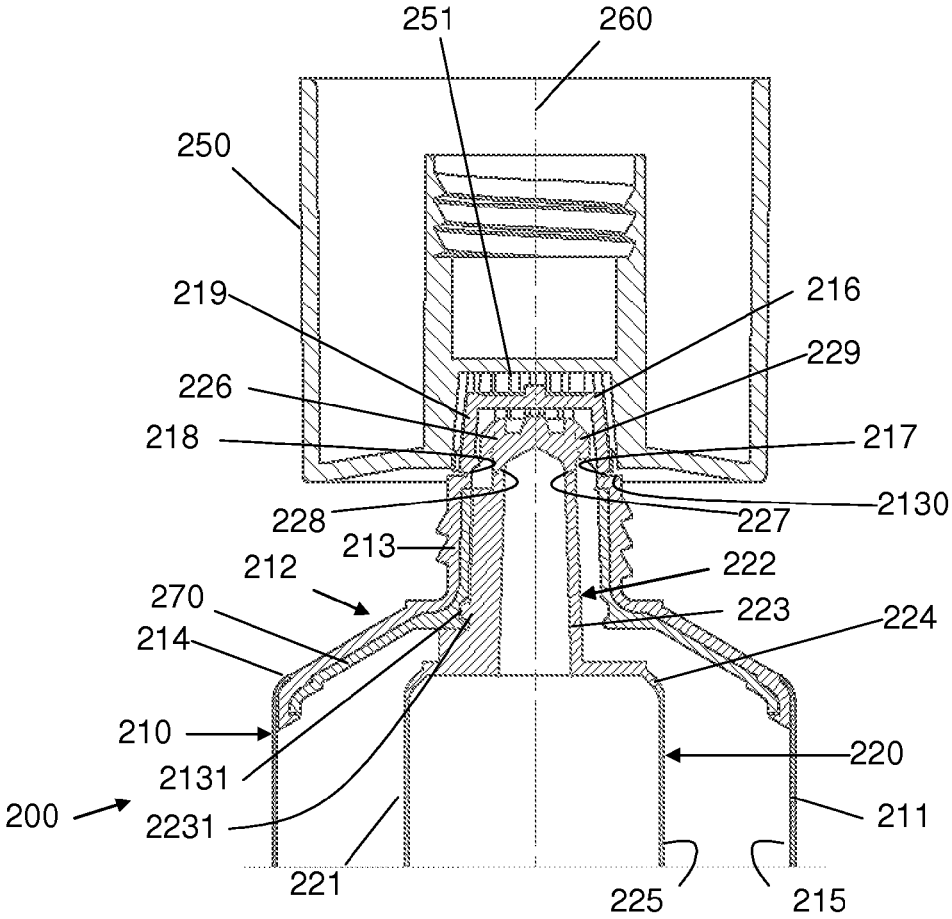
Figure 2C:
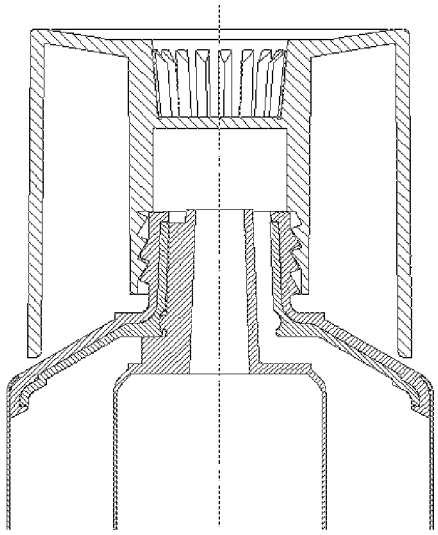
Figure 2D:
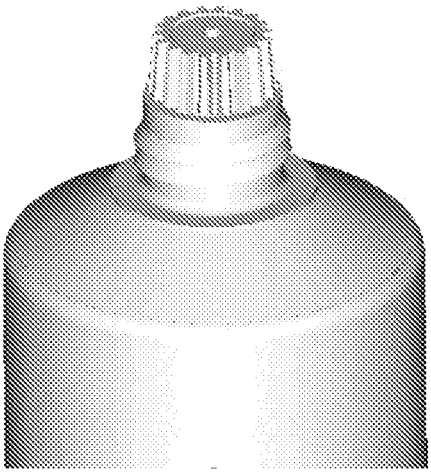
Figure 2E:
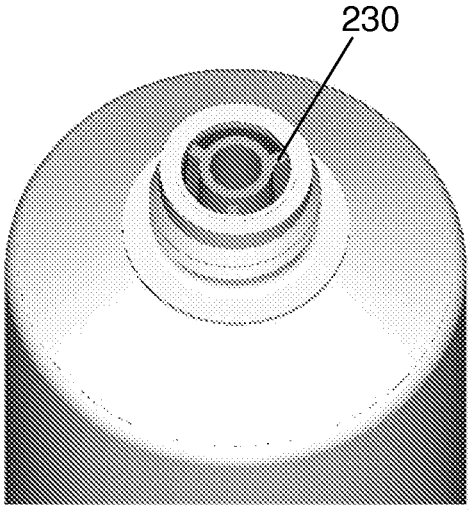
Figure 3A:
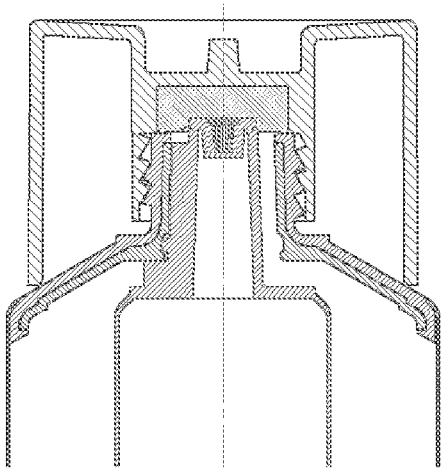
FIGS. 3*a*, 3*b*, 3*c* and 3*d* illustrate a third embodiment of the invention.
Figure 3B:
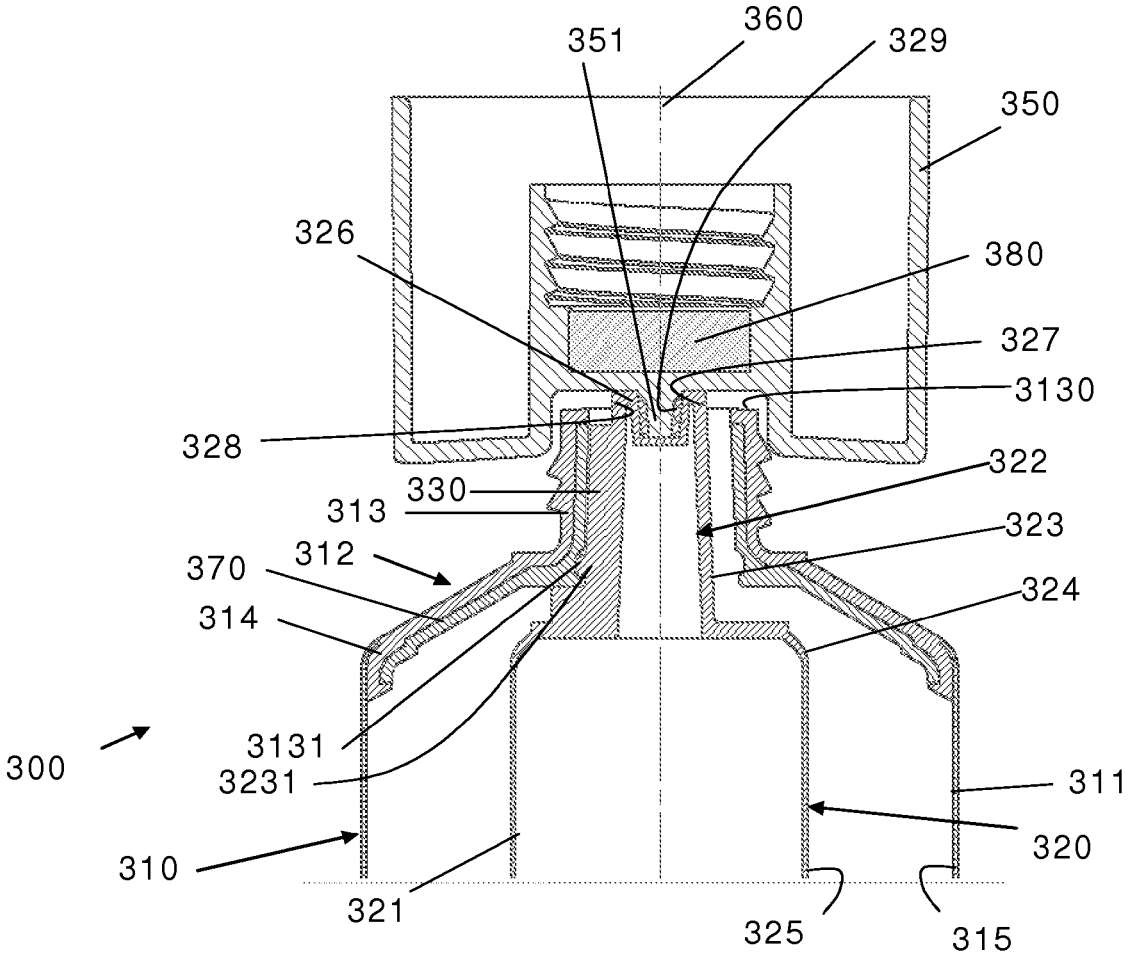
Figure 3C:
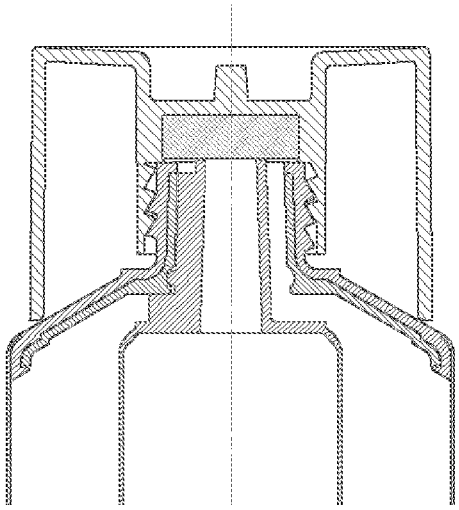
Figure 3D:
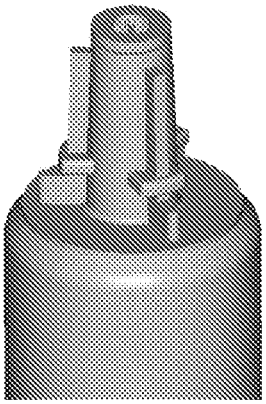

FIGS. 1*a*, 1*b*, 1*c*, 1*d* and 1*e*

FIGS. 1*a* to 1*e* show a double tube 100, including an outer tube 110 and an inner tube 120 housed inside the outer tube 110 so that the volume bounded by the outer surface 125 of the inner tube 120 and the inner surface 115 of the outer tube 110 can contain a pasty product B different from the pasty product A contained in the inner tube 120. The inner tube 120 includes a flexible inner skirt 121 and an inner head 122 provided with an inner neck 123 and an inner shoulder 124 connecting said inner neck to said inner flexible skirt. The outer tube 110 comprises a flexible skirt 111 and an outer head 112 provided with an outer neck 113 and an outer shoulder 114 connecting said outer neck to said outer flexible skirt. Shoulder 114 is provided with an insert 170 made of PBT (polybutylene terephthalate) which acts as an efficient barrier to odors The inner neck 123 is housed inside the outer neck 113. Its cross-section is clover leaf shaped here, such as is illustrated in application WO 00/63111 (but here with three leaves instead of four). It provides a central flow path (with a clover leaf cross-section) for pasty product A and, in combination with the cylindrical surface of the outer neck, three peripheral flow paths for the pasty product B.

The end of the inner neck 123 which surrounds the dispensing opening of the pasty product A is prolonged by a top portion 126 connected to said inner neck by a breakable intermediate zone 127 having a ring-shaped notch 128 whose cross-section in a plane comprising axis 160 is turned in a substantially perpendicular direction to said axis.

The top portion 126 is provided with a side wall 129 which extends the barrel of the inner neck whose cross-section, in the form of a clover leaf, is substantially polygonal concave. This can be easily made to rotate around axis 160.

The slender ring-shaped zone 127 is placed on the side wall of the inner neck 123 so that after assembly of the inner neck and the outer neck, it is on the outer surface of the double tube, i.e. it is "above" the mouth 1130 of the outer neck 113 (the tube being conventionally presented vertically, with the head at the top). When molding the head of the inner tube, the axial position of the slender ring-shaped zone is defined by a certain distance from the clipping system rib 1231 located at the base of the inner neck 123, said distance being greater than the distance between mouth 1130 and clipping system groove 1131 of outer neck 113.

To tear this breakable area when being used for the first time, closure cap 150 is used. The latter has a housing 151 of shape complementary to that of the side wall 129 of the top portion 126. This housing, once the cap has been turned over through 180° (FIG. 1*b*) in relation to its usual closing position (FIGS. 1*a* and 1*e*), acts as a lock inside which the top portion 126 of the inner neck 123, which acts as a key, is inserted. The cap 150 is turned around the axis 160, causing a tear located at the level of the slender ring-shaped zone 127 and the top portion is detached from the neck.

Example 2

FIGS. 2*a*, 2*b*, 2*c*, 2*d* and 2*e*

FIGS. 2*a* to 2*e* show a double tube 200, including an outer tube 210 and an inner tube 220 housed inside the outer tube 210 so that the volume bounded by the outer surface 225 of the inner tube 220 and the inner surface 215 of the outer tube 210 can contain a pasty product B different from the pasty product A contained in the inner tube 220. The inner tube 220 includes a flexible inner skirt 221 and an inner head 222 provided with an inner neck 223 and an inner shoulder 224 connecting said inner neck to said inner flexible skirt. The outer tube 210 comprises a flexible skirt 211 and an outer head 212 provided with an outer neck 213 and an outer shoulder 214 connecting said outer neck to said outer flexible skirt. Shoulder 214 is provided with an insert 270 made of PBT which acts as an efficient barrier to odors.

The inner neck 223 is placed inside the outer neck 213. It is here circular in cross-section and is provided with three radial ribs 230 regularly distributed on its outer surface. It provides a central flow path with circular cross-section for pasty product A and, in combination with the cylindrical surface of the outer neck, three peripheral flow paths for pasty product B.

The end of the inner neck 223 which surrounds the dispensing opening for pasty product A is extended by a top portion 226 connected to said inner neck by a breakable intermediate zone 227 having a ring-shaped notch 228 whose cross-section in a plane comprising axis 260 is turned in a substantially perpendicular direction to said axis.

The top portion 226 is provided with a grooved side wall 229 that can easily be made to rotate around axis 260. To tear this breakable area when using for the first time, closure cap 250 is used. This has a hollow, ribbed housing 251 of complementary shape to that of the side wall 219 of the top portion 216 of outer neck 213. This top portion 216 is connected to outer neck 213 via a notched ring-shaped area 217. The top portion 216 is hollow so that the top portion 226 of the inner tube can be placed in its cavity. The inner and outer surfaces of the side wall 219 are provided with ribs, giving a relief that is complementary to the contour of the side wall 229 of the inner top portion 226 and to the contour of the hollow housing 251 of closure cap 250 respectively, to ensure that the inner 229 and outer 219 top portions are made to rotate relatively and simultaneously.

The notched ring-shaped zone 227 is placed on the side wall of the inner neck 223 so that after assembly of the inner neck and the outer neck, it is "above" the mouth 2130 of the outer neck 213 (the tube being conventionally presented vertically, with the head at the top). When molding the head of the inner tube, the axial position of the slender ring-shaped zone is defined by a certain distance from the clipping system rib 2231 located at the base of the inner neck 223, said distance being greater than the distance between mouth 2130 and clipping system groove 2131 of outer neck 213.

Once cap 250 has been turned through 180°, hollow housing 250 acts as a lock inside which the top portion 216 of the outer neck 213, which acts as a key, is inserted. Cap 250 is turned around axis 260, causing a tear located at the level of the notched breakable ring-shaped zone 217 and another tear at the level of the notched breakable ring-shaped zone 227

Example 3

FIGS. 3*a*, 3*b*, 3*c* and 3*d*

FIGS. 3*a* to 3*d* show a double tube 300, including an outer tube 310 and an inner tube 320 housed inside the outer tube 310 so that the volume bounded by the outer surface 325 of the inner tube 320 and the inner surface 315 of the outer tube 310 can contain a pasty product B different from the pasty product A contained in the inner tube 320. The inner tube 320 includes a flexible inner skirt 321 and an inner head 322 provided with an inner neck 323 and an inner shoulder 324 connecting said inner neck to said inner flexible skirt. The outer tube 310 comprises a flexible skirt 311 and an outer head 312 provided with an outer neck 313 and an outer shoulder 314 connecting said outer neck to said outer flexible skirt. Shoulder 314 is provided with an insert 370 made of PBT which acts as an efficient barrier to odors The inner neck 323 is placed inside the outer neck 313. It is here circular in cross-section and is provided with three radial ribs 330 regularly distributed on its outer surface. It provides a central flow path with circular cross-section for pasty product A and, in combination with the cylindrical surface of the outer neck, three peripheral flow paths for pasty product B.

The end of the inner neck 323 which surrounds the dispensing opening of the pasty product A is prolonged by a top portion 326 connected to said inner neck by a breakable zone 327 having a ring-shaped notch 328 whose cross-section in a plane comprising axis 360 is turned in a substantially perpendicular direction to said axis.

The top portion 326 is provided with an inner ribbed side wall 329 that can easily be made to rotate around axis 360. To tear the breakable area 327 when using for the first time, closure cap 350 is used. This has a protuberance 351 complementary in shape to that of the inner side wall 329 of the top portion 326. Once the cap has been turned through 180° (FIG. 3*b*) in relation to its usual sealing position (FIGS. 3*a* and 3*c*), this protuberance acts as a key which is inserted into the cavity of the top portion 326 of the inner neck 323, this cavity being bounded by the inner ribbed side wall 329 which acts as a lock. The cap 350 is turned around the axis 360, causing a tear located at the level of the slender ring-shaped zone 327 and the top portion is detached from the neck.

The slender ring-shaped zone 327 is placed on the side wall of the inner neck 323 so that after assembly of the inner neck and the outer neck, it is on the surface outer of the double tube, i.e. it is "above" the mouth 3130 of the outer neck 313. When molding the head of the inner tube, the axial position of the slender ring-shaped zone is defined by a certain distance from the clipping system rib 3231 located at the base of the inner neck 323, said distance being higher than the distance between mouth 3130 and the clipping system groove 3131 of the outer neck 313.

A layout of this kind makes it possible to decrease the volume occupied before bursting by the top portion of the inner neck which is above the neck with the multiple opening. The cap can also be provided with a leak-tight seal 380 which, only slightly compressed during storage before being used for the first time (FIG. 3*a*) because of the compactness of said top portion, can easily regain its initial shape and thereby continue to act as a leak-tight seal after said top portion (FIG. 3*c*) has burst.

Example 4

Figure 4A:
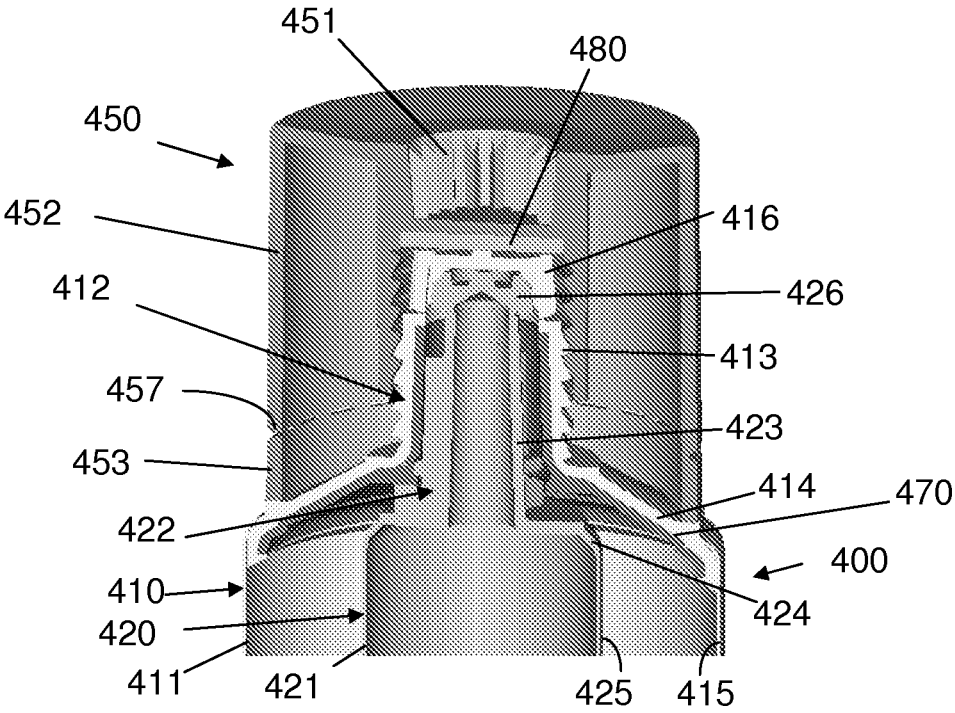
FIGS. 4*a*, 4*b* and 4*c* illustrate an improvement of the second embodiment of the invention in which, by means of the addition of a tamperproof strip, leak-tightness between the products after they have been used for the first time is improved.
Figure 4B:
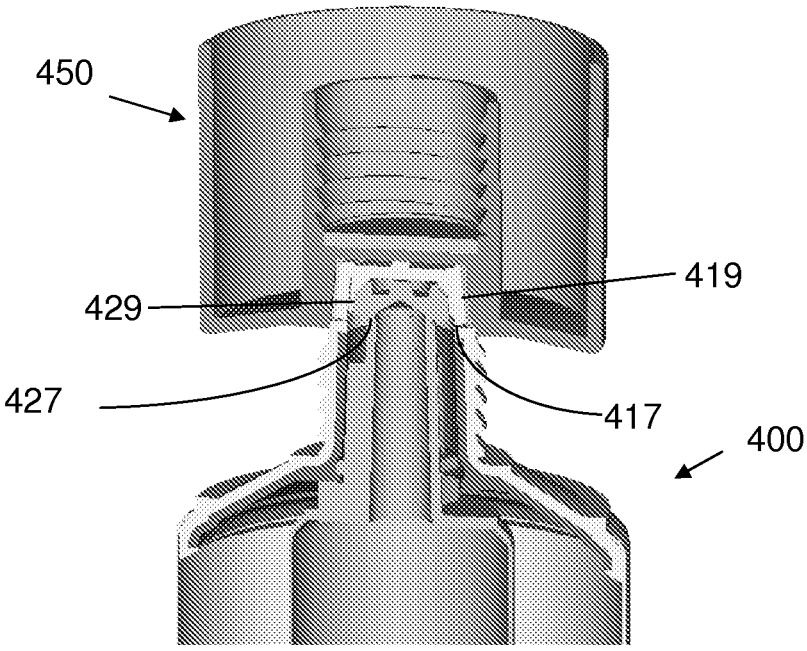
Figure 4C:
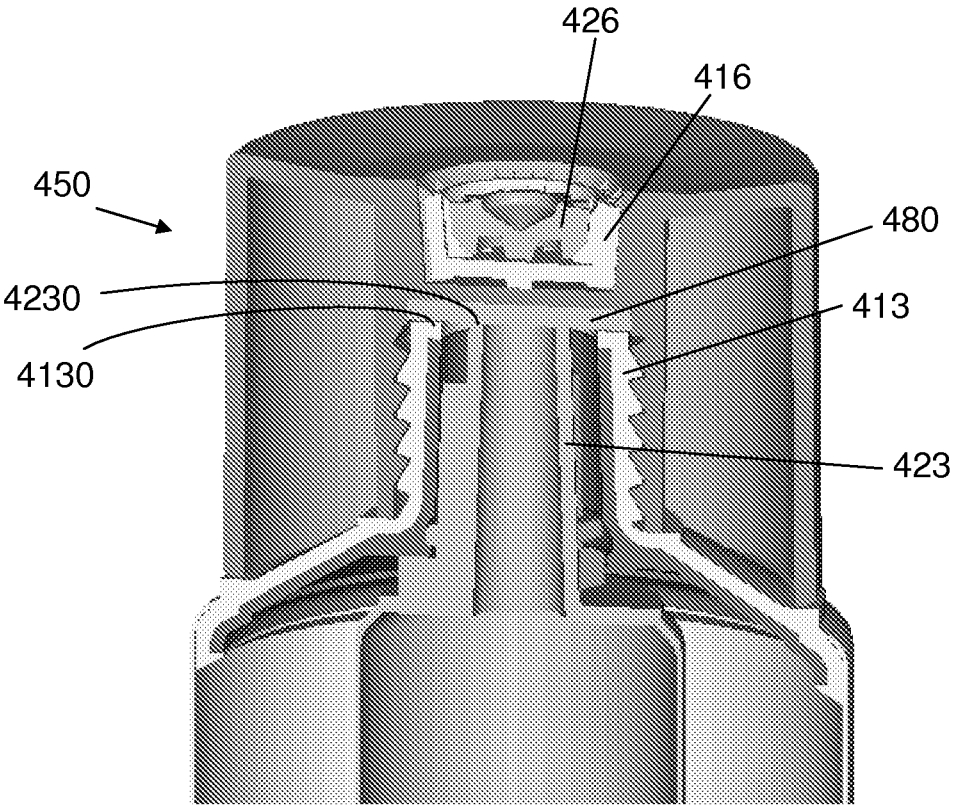

FIGS. 4*a*, 4*b*, and 4*c*

FIGS. 4*a* to 4*c* show an alternative to the double tube shown in example 2, where, through the addition of a strip 453 in the continuation of the opening end of side skirt 452 of cap 450, sealing between products after top portions 416 and 426 have been simultaneously opened when used for the first time, can be significantly improved.

When being used for the first time, the strip 453—which can, for example be, used as a tamperproof device—is torn along the ring-shaped bursting zone 457 and cap 450 is turned through 180° (FIG. 4*b*) to remove the top wall 426 of the inner tube and that 416 of the outer tube, by rotation. The open end of the skirt arrives, in closed position, near shoulder 414 of the tube head. The height of strip 453 is substantially equal to that of the top portion 416 of the outer tube, which is above the notched ring-shaped breakable area 417, so that, when cap 450 is once again turned through 180° to close the opening, the leak-tight seal 480 comes in contact with the mouth 4230 of the inner neck 423 and 4130 of the outer neck 413.

Double tube 400 includes an outer tube 410 and an inner tube 420 housed inside the outer tube 410 so that the volume bounded by the outer surface 425 of the inner tube 420 and the inner surface 415 of the outer tube 410 can contain a pasty product B different from the pasty product A contained in the inner tube 420.

The inner tube 420 includes a flexible inner skirt 421 and an inner head 422 provided with an inner neck 423 and an inner shoulder 424 connecting said inner neck to said inner flexible skirt. The outer tube 410 comprises a flexible skirt 411 and an outer head 412 provided with an outer neck 413 and an outer shoulder 414 connecting said outer neck to said outer flexible skirt. Shoulder 414 is provided with an insert 470 made of PBT which acts as an efficient barrier to odors.

The end of inner neck 423 which surrounds the dispensing opening of pasty product A is prolonged by a top portion 426 connected to said inner neck by a breakable intermediate zone 427. The top portion 426 is provided with a grooved side wall 429 that can easily be made to rotate. To tear this breakable area when using for the first time, closure cap 450 is used. This has a hollow, ribbed housing 451 of complementary shape to that of the side wall 419 of the top portion 416 of outer neck 413. This top portion 416 is connected to outer neck 413 via a notched ring-shaped area 417. The top portion 416 is hollow so that the top portion 426 of the inner tube can be housed in its cavity. The inner and outer surfaces of the side wall 419 are provided with ribs, giving a relief that is complementary to the contour of the side wall 429 of the inner top portion 426 and to the contour of the hollow housing 451 of closure cap 450 respectively, to ensure that the inner 429 and outer 419 top portions are made to rotate relatively and simultaneously.

The slender ring-shaped zone 427 is placed on the side wall of the inner neck 423 so that after assembly of the inner neck and the outer neck, it is on the outer surface of the double tube, i.e. it is "above" the mouth 4130 of the outer neck 413. When molding the head of the inner tube, the axial position of the slender ring-shaped zone is defined by its distance from the clipping system rib of the inner neck 423, which must be greater than the distance between mouth 4130 and the clipping system groove of the outer neck 413.

Once cap 450 has been turned through 180°, hollow housing 451 acts as a lock inside which the top portion 416 of the outer neck 413, which acts as a key, is inserted. Closure cap 450 is turned around the axis, causing a tear located at the level of the notched breakable ring-shaped zone 417 and another tear at the level of the notched breakable ring-shaped zone 427. As the mouth 4230 of the inner neck 423 remains above mouth 4130 of the outer neck 413, the leak-tight seal 480 first comes into contact with the inner mouth 4230 to ensure leak-tightness between products. This leak-tight seal 480 is made from an elastomer. It is flexible and thick enough to also come into contact with the outer mouth 4130 and to ensure that the products are properly sealed in relation to the outside.

In the example illustrated, hollow ribbed housing 451 has a shape that is complementary and very similar to that of the side wall 419 of the top portion 416 of the outer neck 413, so that after the breakable zone 417 has burst, said top portion remains trapped in said hollow housing, acting as proof that the recipient has been used for the first time. Similarly, the top portion 426 of the inner tube can also remain trapped in the hollow of the top portion 416 of the outer tube.

The invention claimed is:

1. A double dispensing container including an outer container and an inner container, said inner container being designed to contain a pasty product A and being housed inside said outer container so that the volume bounded by its outer surface and the inner surface of the outer container can contain a pasty product B, each container including a body and a head provided with a neck and a shoulder connecting said neck to said body, said neck having a side wall and an open end provided with one or more dispensing openings, the neck of the inner container being housed inside the neck of the outer container and having a cross-section of a shape such as to offer one or more flow paths for pasty product A, leading to a single or multiple dispensing opening for product A and, in combination with the inner surface of the neck of the outer container, one or more flow paths for pasty product B, leading to a single or multiple dispensing opening for product B, said inner neck being prolonged by a top portion which is connected to said inner neck by a slender ring-shaped zone and which closes the single or multiple dispensing opening for product A, wherein said slender ring-shaped zone is placed on the side wall of the inner neck so that after assembly of the inner neck and the outer neck, bursting of the slender ring-shaped zone, followed by detachment of said top portion, the open end of the inner neck is above the mouth of the outer neck, the containers being presented vertically, with the head at the top;

wherein the container further comprises a cap carrying a single leak-tight seal which is configured to close hermetically said openings for products A and B by being compressed onto the open end of the inner neck and the mouth of the outer neck.

2. A double dispensing container according to claim 1, in which said slender ring-shaped zone is a breakable area which extends on the side wall of the inner neck with a notch whose cross-section in a plane comprising the axis of the inner neck is turned in a direction that is substantially perpendicular with said axis.

3. A double dispensing container according to claim 2 in which said notch is placed on the side wall of the neck of the inner container so that after assembly of said neck of the inner container and the neck of the outer container, it is above the mouth of said neck of the outer container, the containers being presented vertically, with the head at the top.

4. A double dispensing container according to claim 1 in which said top portion is provided with a side wall that is grooved or has a polygonal cross-section.

5. A double dispensing container according to claim 4 in which said side wall is the outer wall of the top portion wherein it is provided with the closure cap comprising a hollow housing of a shape complementary to that of said side wall.

6. A double dispensing container according to claim 1 in which the outer neck is also prolonged by a top portion which is connected to said outer neck by a slender ring-shaped zone.

7. A double dispensing container according to claim 5 in which said top portion of the outer container has a side wall and is hollow so that the top portion of the inner container can be housed in its cavity, the inner and outer surfaces of the side wall being provided with ribs which offer a relief that is complementary to the contour of the side wall of the inner top portion and to the contour of the hollow housing of the closure cap respectively, to ensure that the inner and outer top portions are made to rotate relatively and simultaneously.

8. A double dispensing container according to claim 7, in which closure cap has an outer side skirt whose open end arrives, in closed position, near shoulder of the outer container head and which has at said end a detachable strip, of width substantially equal to the height of the top portion of the outer container.

9. A double dispensing container according to claim 4, wherein the side wall is concave in cross section.

10. A double dispensing container according to claim 4, wherein the side wall is star-shaped in cross section.

11. A double dispensing container according to claim 8, wherein the detachable strip is tamperproof.

12. A double dispensing container according to claim 1, wherein the axial position of the slender ring-shaped zone is defined by a distance from a clipping system rib, said distance being greater than the distance between the mouth of the outer neck and a clipping system groove.

* * * * *